United States Patent [19]

Buehler

[11] Patent Number: 4,742,836

[45] Date of Patent: May 10, 1988

[54] FINGERNAIL CLEANING DEVICE

[76] Inventor: Arnold A. Buehler, 9545 Meade Ave., Oak Lawn, Ill. 60453

[21] Appl. No.: 65,352

[22] Filed: Jun. 23, 1987

[51] Int. Cl.[4] ..... B08B 3/02

[52] U.S. Cl. ..... 134/182; 134/201; 132/74.5; 132/75; 128/366; 4/623; 4/624

[58] Field of Search ..... 134/182, 183, 200, 201; 128/366; 604/289; 132/74.5, 75; 422/28, 292; 4/619, 623, 622, 624

[56] References Cited

U.S. PATENT DOCUMENTS

| | | | |
|---|---|---|---|
| 3,691,577 | 9/1972 | Bliss | 134/172 X |
| 3,943,951 | 3/1976 | Spotz | 134/200 X |
| 3,982,965 | 9/1976 | Spotz | 134/200 X |
| 4,020,856 | 5/1977 | Masterson | 132/74.5 |
| 4,119,439 | 10/1978 | Boucner | 134/183 |
| 4,137,929 | 2/1979 | Grossman | 134/182 |
| 4,289,152 | 9/1981 | Funre | 134/182 X |
| 4,670,010 | 6/1987 | Dragone | 422/292 X |

*Primary Examiner*—Harvey C. Hornsby
*Assistant Examiner*—Frankie L. Stinson
*Attorney, Agent, or Firm*—Wallenstein, Wagner, Hattis & Strampel, Ltd.

[57] ABSTRACT

A fingernail device which includes a receptacle having a small diameter fluid passageway positioned at an angle to the base of the receptacle. The passageway has a nozzle which directs fluid at a downward angle to the upper surface of the base of the receptacle to create a high-velocity, shallow, fan-shaped fluid stream which flows along and substantially parallel to said base in the direction of the finger tips which are in contact with the base in proximity to the nozzle. The receptacle has a depth such that the level of the fluid retained in it during a cleaning operation will develop a head sufficient to eliminate any splashing, spray-out or extreme turbulance of the fluid in the receptacle. Passageway means are provided for entraining a cleansing agent in the fluid stream.

6 Claims, 3 Drawing Sheets

FINGERNAIL CLEANING DEVICE

TECHNICAL FIELD

This invention relates to a cleaning device, especially to a cleaning device for rapidly and effectively cleaning fingernails which can be used with equal facility and safety by an adult or child.

BACKGROUND OF THE PRIOR ART

Apparatus and/or appliances for cleaning fingernails are the subject matter of a number of U.S. patents. Thus, U.S. Pat. Nos. 3,943,951 and 3,982,965 disclose appliances which include a chamber for receiving a single finger. The nail of each finger is separately cleaned by means of a jet nozzle for discharging a pulsating, pump actuated jet of water against the fingernails of a user as they are sequentially inserted into the chamber. U.S. Pat. No. 4,020,856 shows a fingernail and hand cleaning appliance which comprises a lower housing and an upper housing. The lower housing includes a reservoir and a pump, while the upper housing includes an opening fitted with a flexible gasket to enable the hand of a user to be inserted into the upper housing. A palm ball, having six finger grooves, is provided in the upper housing for receiving the user's hand. A nozzle is mounted at the end of each of the finger grooves to direct a pump actuated jet of water toward the end of each finger. U.S. Pat. No. 4,119,439 discloses a nail cleaning unit comprising a basin and a detachable hood for the basin. The unit utilizes a spray manifold having a plurality of orifices for directing water from a pump against the hand and fingernails of a user which is inserted through an opening in the hood. U.S. Pat. No. 4,137,929 discloses a fingernail cleaning apparatus comprising a receptacle adapted to receive one or more of a user's fingers to be cleaned. The apparatus includes nozzle means which may comprise one or more raised jets for directing a cleaning fluid at an angle against the underside of the fingernails, or may comprise a curved tube having liquid jet openings formed along the length thereof. During cleaning, the fingernails of the user are held in an elevated position in proximity to the fluid jets. U.S. Pat. No. 4,258,734 shows an appliance for cleaning a single fingernail, or toe nail of a user. The appliance has a water jet nozzle having a tapered end adapted to be inserted under each fingernail or toe nail as it is cleaned. A spray shield surrounds the jet nozzle, and is provided with an opening for admitting a finger or toe into contact with the tapered end of jet nozzle. U.S. Pat. No. 4,289,152 shows a fingernail cleaning apparatus comprising a housing provided with an opening in a sidewall thereof for admitting one finger of a user. A pump feeds water to a nozzle in the housing against which the fingertip of a finger rests during cleaning. A pointed projection is mounted in the nozzle for enabling a user to push the skin away from the fingernail during cleaning.

BRIEF SUMMARY OF THE INVENTION

In accordance with the present invention, a fingernail cleaning device has been evolved which enables all of the fingernails on the hand of a user to be rapidly and effectively cleaned at one time by means of only a single, fluid emitting nozzle. The device can be used with equal facility by adults and children with complete safety. It can be readily and easily connected to a sink faucet for indoor use, or to a garden hose for outdoor use. Its ability to operate on local water line pressure eliminates the need for using a pump to increase fluid pressure. The lightweight construction of the device permits it to be easily moved to any convenient location for use. Although constructed of lightweight materials, it is rugged enough to withstand rough handling without exposing the single, fluid emitting nozzle to possible damage. Detergents, cleansing agents, or the like, can be easily introduced into the fluid stream emitted by the nozzle to enhance and speed-up the cleaning action of the device.

In brief, the device comprises an open-topped receptacle in which is mounted a slanted, small diameter fluid passageway. From the nozzle end of the fluid passageway, fluid is emitted at a downward angle to the upper surface of the base of the receptacle with the result that the fluid is deflected by said surface and is formed into a high velocity, fan-shaped, shallow stream which flows along said surface in a plane substantially parallel thereto. The receptacle advantageously has a depth such that the level of the fluid retained in the receptacle during a cleaning operation will develop a head sufficient to eliminate any splashing, spray-out or extreme turbulence of the fluid both while the nails of a user are positioned in the high velocity stream, and after they are removed from the receptacle. The device is further desirably provided with fluid deflector means for intercepting fluid when the device is initially put into operation thereby preventing any splashing, or spray-out upon start-up. The deflector means, during operation of the device, also acts in cooperation with the fluid retained in the receptacle to prevent splashing, or spray-out, and extreme turbulence. In a preferred embodiment of the invention, the receptacle is provided with opposed fluid drains or outlets which are positioned at an elevation above the bottom or base of the receptacle to enable fluid retained in the receptacle to develop a head sufficient for the purposes noted hereinabove. As an added feature, the device is provided with a fluid inlet conduit having adapter and coupling means to permit the device to be readily connected to a sink faucet, or to the end of a garden hose, for example. As an optional feature, provision is made for connecting the small diameter fluid passageway of the device to a source of a cleansing agent such as soap, or a grease solvent, which will be entrained in the stream of fluid passing through the outlet or nozzle end of said passageway.

While the device is especially adapted for use in cleaning fingernails, it can also be effectively used for cleaning articles of jewelry such as rings, or for cleaning mechanical parts and accessories such as bearing rings, fittings and small tools, and even paint brushes, to mention a few. It also can be used for laundering purposes.

The foregoing, and other features and advantages of the invention will become more apparent from the description to follow, taken in conjunction with the accompanying drawings.

DETAILED DESCRIPTION OF THE INVENTION

Figure 1:
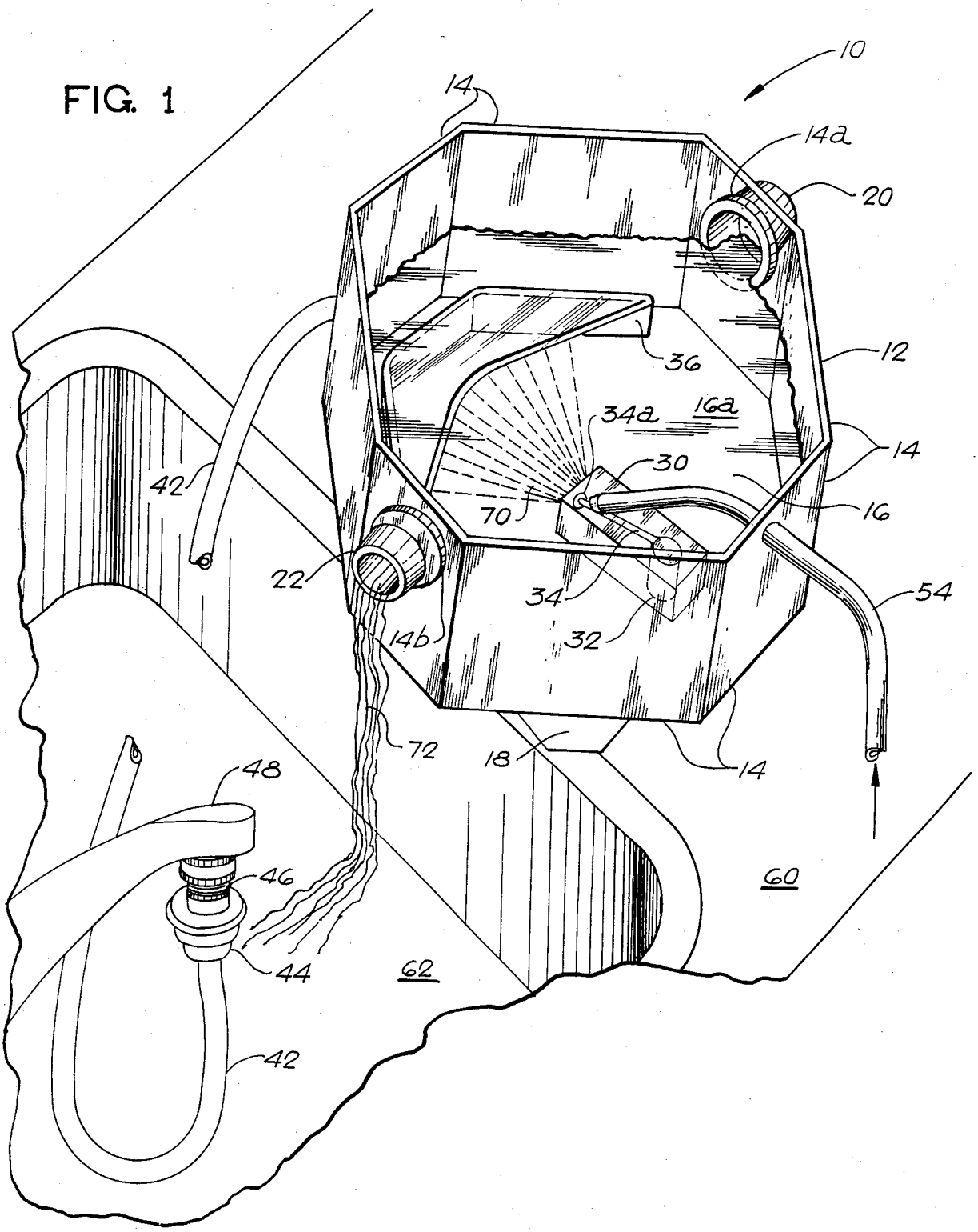
FIG. 1 is a view in perspective of an embodiment of the device of the present invention showing it positioned next to a sink, and the fluid inlet conduit connected to the sink faucet.

The embodiment of the device illustrated, and designated generally by reference numeral 10, comprises an open-topped receptacle 12 having sidewalls 14 extending upwardly from a flat bottom or base 16. Legs 18 advantageously are joined to the underside of the bottom or base 16 for reasons that will become clear as the description proceeds. The receptacle 12, including the legs 18, are desirably formed of a lightweight material such as plastic, and may be formed as a unitary, integral unit. While the receptacle 12 is shown as being octagonal in shape, it should be understood that it can be any shape desired, including round, square, or rectangular.

The sidewalls 14 of the receptacle 12 are provided with opposed openings **14*a* and 14*b* for receiving a removable drain plug 20 and a removable drain tube 22. A conduit, not shown, may be connected to the tube 22 to convey cleaning fluid to a drainage area remote from the receptacle 12. The plug 20 and the tube 22 are interchangeable in the openings 14*a* and 14*b* to enable the receptacle 12** to be positioned on either side of a sink, for example.

A fluid inlet member 30 is joined to the upper surface **16*a* of the bottom or base 16 of the receptacle 12. The member 30 may be formed integral with the base 16 or it may be formed as a separate element and secured to the base 16 as by plastic cement, or by suitable fastening means such as screws. As shown, the member 30 is provided with an internally threaded vertical bore 32 and a slanted or angled small diameter bore which forms a fluid passageway 34 in communication with the upper end of the bore 32. The angle of declination of the bore 34 relative to the surface 16*a* of the base 16 may range from about 3 to about 35 degrees, preferably about 10 to about 15 degrees. The outlet or nozzle 34*a* of the passageway 34 is positioned a short distance above the surface 16*a* of the base 16. Also joined to the upper surface 16*a* of the bottom or base 16 is a fluid deflector 36. The deflector 36, as shown, has a fan-shaped configuration, and desirably is formed integral with the receptacle 12**.

The bore 32 in the member 30 receives an externally threaded fitting 40 which is in communication with a cleaning fluid conduit 42. The conduit 42 advantageously is supported in spaced relation to the undersurface **16*b* of the bottom or base 16 of the receptacle 12 by passing it through a bore 18*a* formed in one of the legs 18 of the receptacle. The conduit 42 desirably is fabricated of a flexible plastic material, and is provided at its inlet end 42*a* with a snap-coupling 44. The coupling 44 is adapted to receive one end of an aerator 46. The aerator 46 is provided with internal and external threads to enable it to be attached to any standard sink faucet such as faucet 48 (see FIG. 1). To enable the device 10 to be attached to a garden hose for outdoor use, for example, an internally and externally threaded hose adapter 50** is provided.

As an optional feature, the fluid inlet member 30 may be provided with a restricted bore 52 which intersects with the small diameter passageway 34 upstream of the nozzle **34*a* thereof. The bore 52, in turn, is counterbored to enable an end of a flexible conduit 54, in communication with a source (not shown) of a cleansing agent such as a solution of a detergent, or grease cutter, to be positioned in proximity to the bore 52. The venturi action created by the flow of fluid through the small diameter passageway 34 acts to draw the detergent solution into the fluid in the passageway 34**.

Figure 3:
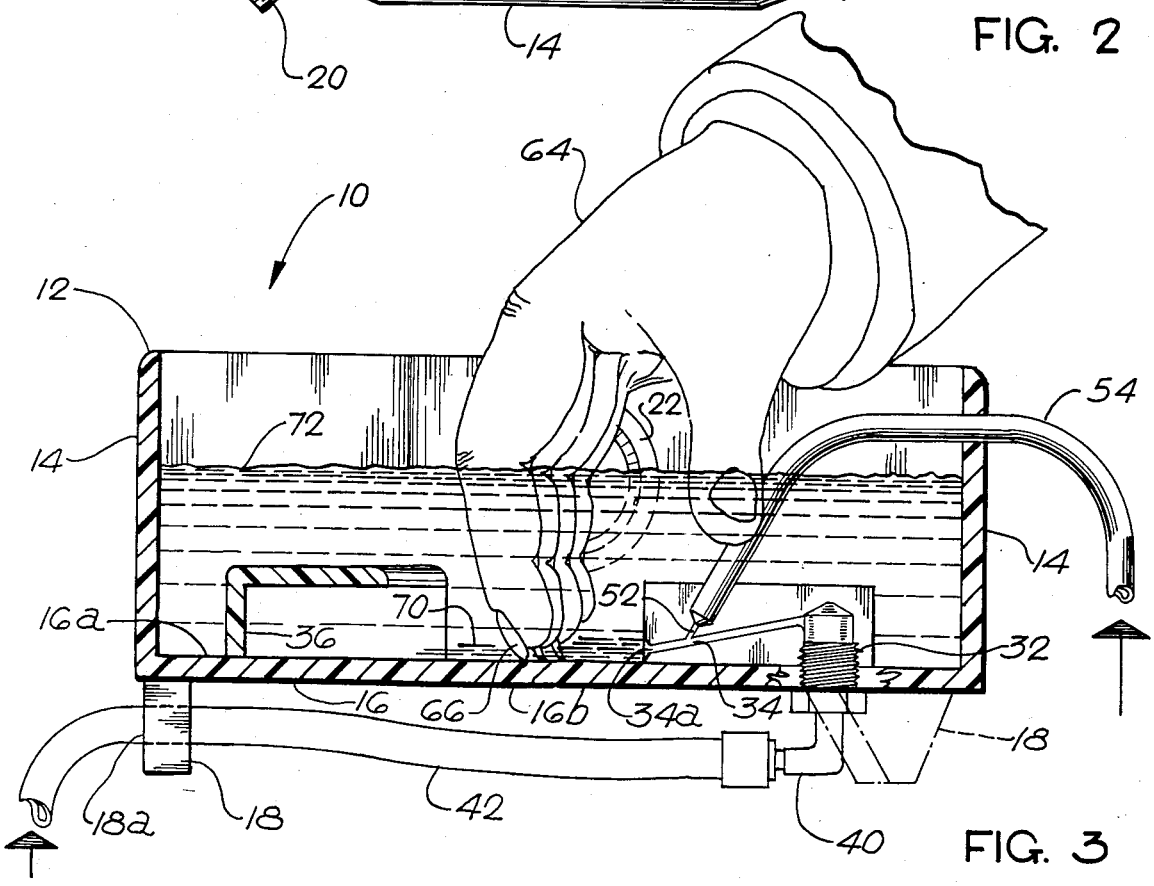
FIG. 3 is a vertical sectional view taken substantially along line 3—3 of FIG. 2.
Figure 4:
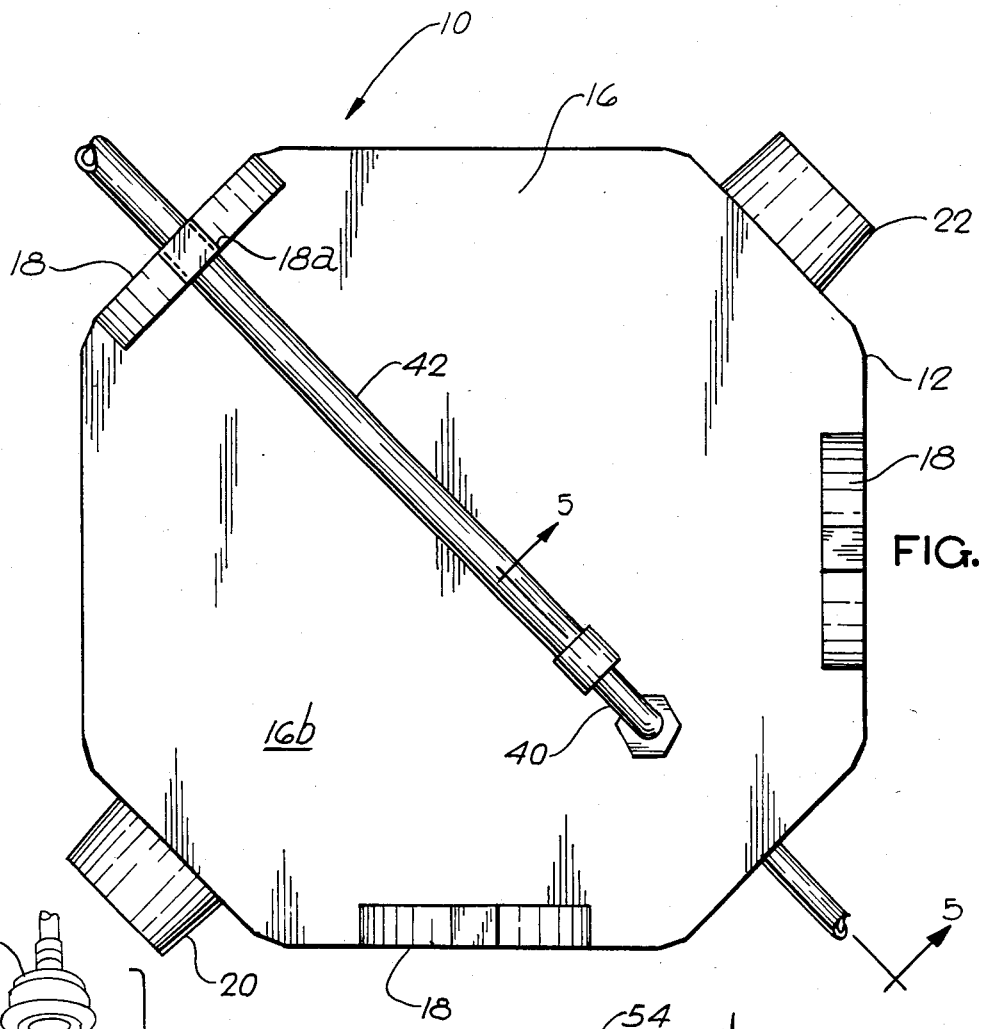
FIG. 4 is a bottom view of said embodiment of the device.
Figure 6:
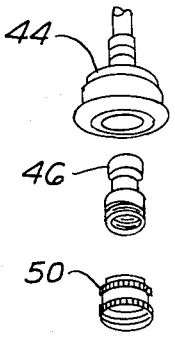
FIG. 6 is an exploded view of the adapter and snap-coupling elements provided for the fluid inlet conduit of the device.
Figure 5:
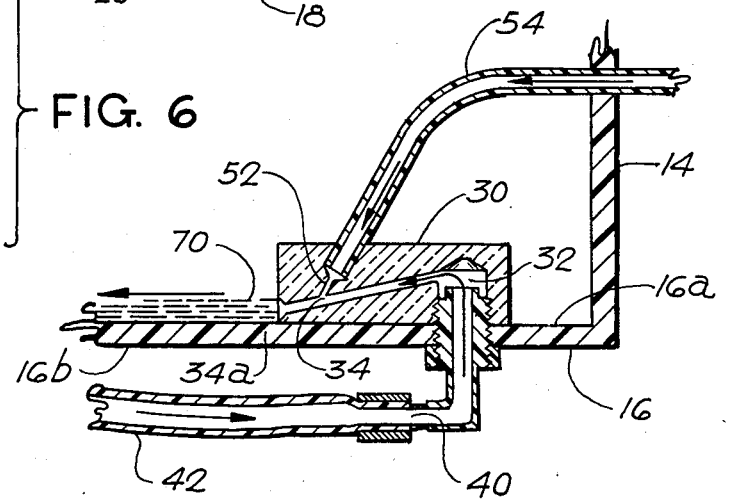
FIG. 5 is a vertical sectional view taken substantially along line 5—5 of FIG. 4.

In utilizing the fingernail device 10, it is first placed on a sink counter, for example, such as counter 60 (see FIG. 1), with the drain tube 22 extending over the sink 62 so that excess fluid in the receptacle 12 will spill into the sink. The inlet end **42*a* of the conduit 42 is attached to the faucet 48 by means of the coupling 44, and the aerator 46 which has been threaded into engagement with the outlet of the faucet. The faucet 48 is then turned on to permit the receptacle 12 to slightly fill with fluid. The deflector 36 acts to intercept any cleaning fluid which may splash from, or spray-out of the receptacle. The temperature of the fluid, and its rate of flow through the nozzle 34*a* of the passageway 34 can be controlled as desired by the user by simply turning the faucet control handles. The user then places one hand 64 in the receptacle 12 with the fingertips in contact with the upper surface 16*a* of the base 16, and the underside of the fingernails 66, facing toward the nozzle 34*a*, as illustrated in FIG. 3. The user moves his hand from side to side to expose the nails to the optimum cleaning action of the fluid emitting from the nozzle 34*a***.

Figure 2:
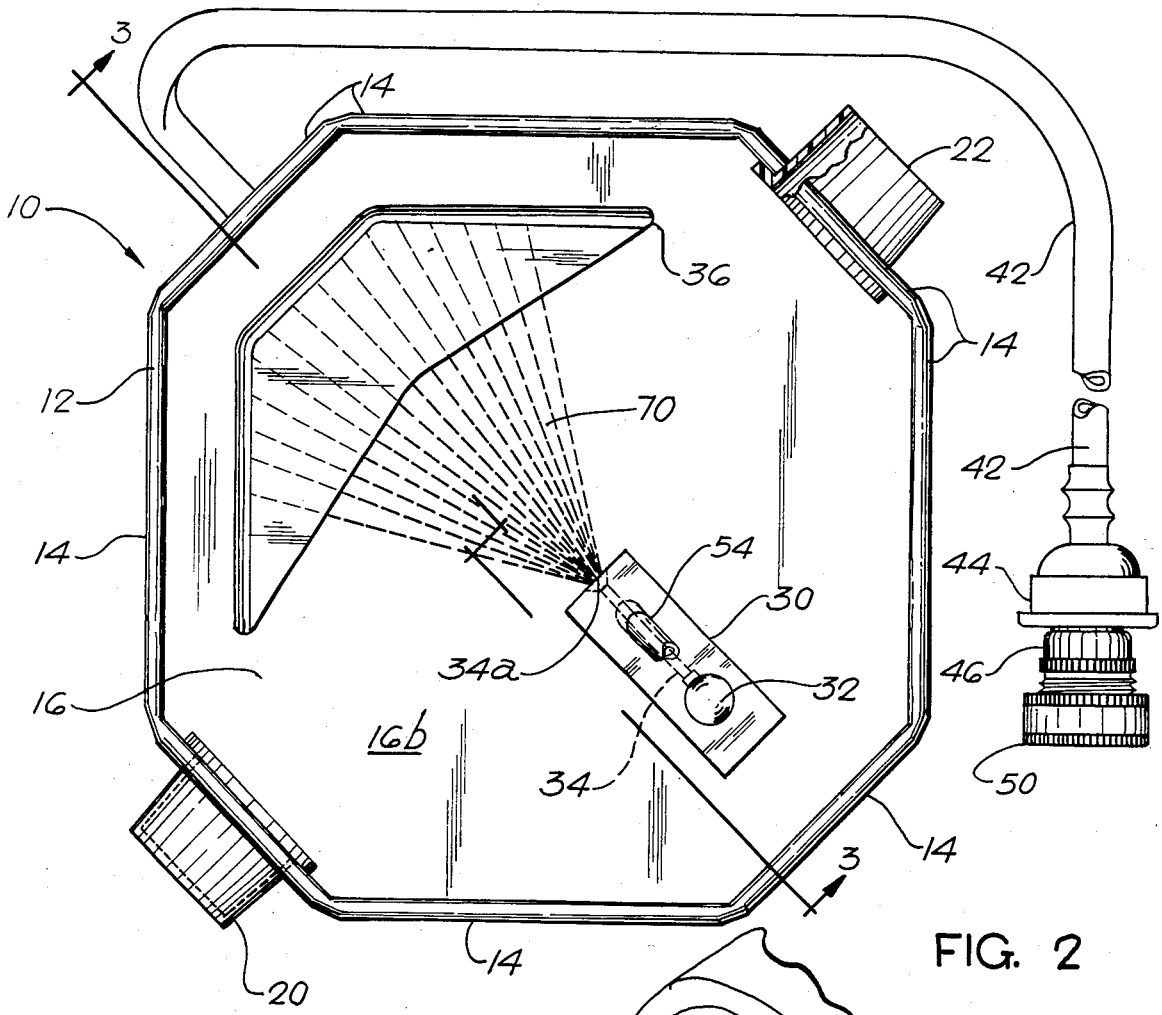
FIG. 2 is a top plan view of said embodiment of the device showing the fan-shaped configuration of the cleaning fluid stream.

As best shown in FIGS. 2 and 3, the small diameter passageway 34 and its nozzle **34*a* direct fluid at a downward angle onto the upper surface 16*a* of the base 16 to create a high-velocity, shallow, fan-shaped stream 70 which flows in a path along and substantially parallel to the upper surface 16*a* of the base 16. As the fluid 72 in the receptacle 12 approaches the approximate level shown in FIG. 3, the fluid, while still spilling into the sink 62 through the elevated drain tube 22, establishes a head which, in cooperation with the deflector 36, prevents any splashing or spraying of fluid from the receptacle during cleaning. In addition, any noise developed by the high velocity stream is also reduced to a negligible level by the fluid head and the deflector. After the nails of the fingers have been cleaned, the thumbnail can be moved from side to side in the stream 70 until it is cleaned. The operation is then repeated with the other hand of the user. At the same time that the nails of a user are being cleaned, the cuticles of the fingers can be effectively cleaned by positioning them in the path of the high velocity stream 70. If the use of a cleansing agent is required to remove grease or grime from under the nails, a few drops of liquid detergent or grease cutter may first be added to the receptacle before the cleaning operation is initiated, or, in the case where the device is provided with the optional cleansing agent feed feature described above, a cleansing agent can be continuously entrained in the fluid stream 70 through the conduit 54. The level of the fluid in the receptacle 12** in such cases acts to cause the cleansing agent to be recirculated in the direction of the fingertips thereby enhancing the cleansing action of the device.

While the fingernail cleaning device of the present invention has been described and illustrated with relation to a specific embodiment thereof, it should be understood that such description and showing have been given by way of illustration and example, and that changes and modifications may be made therein without departing from the spirit and scope of the invention.

What I claim is:

1. A fingernail cleaning device, comprising: a receptacle for receiving and maintaining a cleaning fluid at a predetermined level therein, said receptacle having an open top for enabling the fingers of one hand of a user to be placed in the receptacle and a bottom in contact with which the fingertips of said one hand of a user are placed during cleaning of the fingernails; and a small diameter fluid passageway positioned in the receptacle at an acute angle with relation to the bottom of the receptacle, said passageway being in communication with a source of a cleaning fluid and acting to direct cleaning fluid at a downward angle to the bottom of the receptacle to provide a high-velocity, fan-shaped stream of the cleaning fluid which travels along the bottom of the receptacle in the direction of the fingernails of the user, said predetermined level of fluid in the receptacle acting to provide sufficient fluid pressure above said stream to substantially prevent any splashing of fluid from the receptacle by said stream during cleansing of the nails.

2. A fingernail cleaning device according to claim 1 wherein cleaning fluid deflector means is positioned in the receptacle, said deflector means cooperating with the fluid pressure due to said predetermined level of cleaning fluid in the receptacle to substantially prevent splashing, or spray-out of cleaning fluid from the receptacle.

3. A fingernail cleaning device according to claim 1 wherein the receptacle is provided with a flexible conduit, the inlet end of the conduit being provided with adapter and coupling means to enable it to be attached to a faucet or a garden hose.

4. A fingernail cleaning device according to claim 1 wherein the receptacle is provided with cleaning fluid drain means, said means being located at an elevated position with relation to the bottom of the receptacle to enable said predetermined level of cleaning fluid to be established in the receptacle.

5. A fingernail cleaning device according to claim 1 wherein the small diameter fluid passageway is positioned at an angle of about 3 to about 35 degrees with relation to the bottom of the receptacle.

6. A fingernail cleaning device according to claim 1 wherein a restricted passageway intersects the small diameter fluid passageway at a point upstream of said fluid passageway, said restricted passageway being in communication with a source of a cleansing agent which passes through said restricted passageway and is entrained in the fluid passing through said fluid passageway.

* * * * *